United States Patent [19]

Goralski et al.

[11] Patent Number: 4,844,967

[45] Date of Patent: Jul. 4, 1989

[54] BACK UP PAD WITH DRIVE ADAPTER AND OFFSET PASSAGEWAYS

[75] Inventors: Edwin A. Goralski, St. Paul; David C. Roeker, Troy Township, St. Croix County, both of Minn.

[73] Assignee: Minnesota Mining and Manufacturing Company, Saint Paul, Minn.

[21] Appl. No.: 258,037

[22] Filed: Oct. 14, 1988

[51] Int. Cl.[4] ..... B32B 3/26; B32B 5/20; B32B 31/00

[52] U.S. Cl. ..... 428/137; 156/78; 156/79; 156/245; 156/250; 156/500; 156/513; 156/514; 264/46.4; 264/154; 428/64; 428/65; 428/304.4

[58] Field of Search ..... 156/78, 79, 245, 250, 156/252, 253, 500, 513, 514; 264/46.4, 154; 428/64, 65, 66, 137, 304.4

[56] References Cited

U.S. PATENT DOCUMENTS

| | | | |
|---|---|---|---|
| 4,447,484 | 5/1984 | Slosberg et al. | 156/79 |
| 4,474,635 | 10/1984 | Adams | 156/245 |
| 4,520,061 | 5/1985 | Stoll | 428/137 |
| 4,792,475 | 12/1988 | Bien et al. | 428/137 |

*Primary Examiner*—William J. Van Balen

*Attorney, Agent, or Firm*—Donald M. Sell; Walter N. Kirn; William L. Huebsch

[57] ABSTRACT

A coated abrasive back up pad is disclosed that may be attached to different types of drive motor assemblies by a simple rearrangement of an adapter included in the back up pad. The back up pad may have passageways with offset portions in a foam layer of the pad positioned to communicate between openings in an abrasive disk attached to the back up pad and vacuum systems in various drive motor assemblies to which it may be attached. A novel method is disclosed for molding the back up pad to form such passageways which includes molding dies into the pad that can later be removed by compressing the foam layer so that the dies cut outlet openings through which they are then removed.

11 Claims, 3 Drawing Sheets

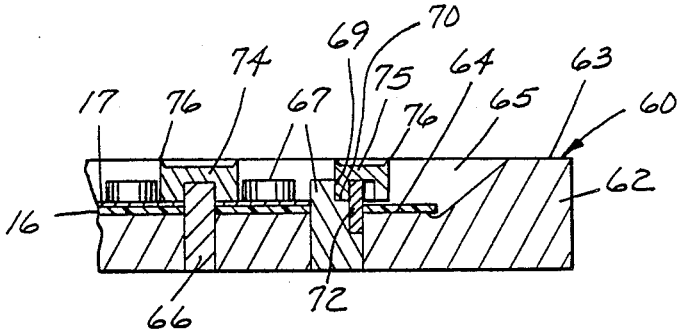
Fig. 8
Fig. 10
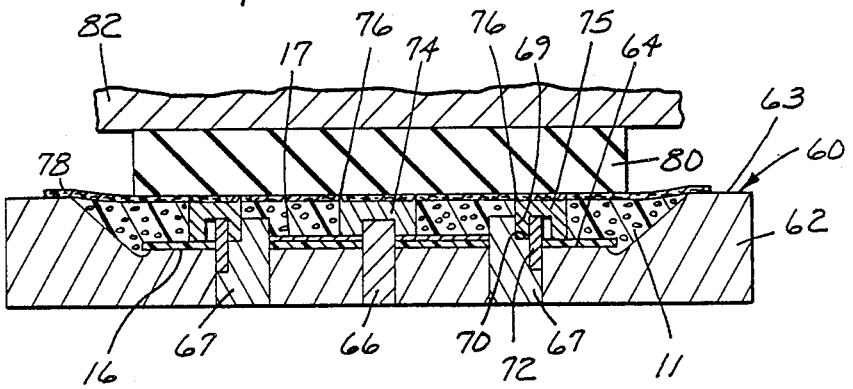
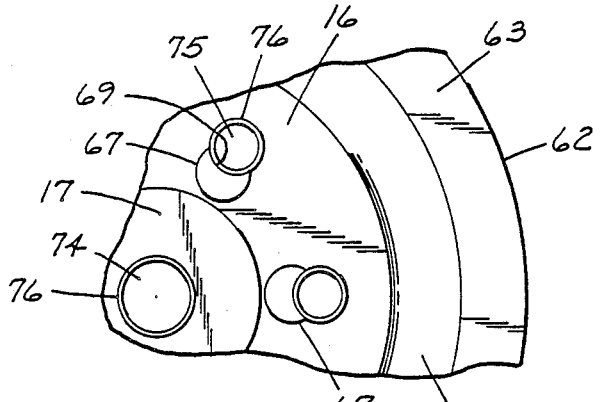
Fig. 9

BACK UP PAD WITH DRIVE ADAPTER AND OFFSET PASSAGEWAYS

TECHNICAL FIELD

The present invention relates to structures for attaching coated abrasive back up pads to drive mechanisms, back up pads which have passages in a foam layer thereof through which the drive mechanism may suck dust during an abrading process, and methods for making the back up pads.

DISCLOSURE OF INVENTION

The present invention provides a coated abrasive back up pad that may be attached to different types of drive motor assemblies by a simple rearrangement of an adapter included in the back up plate, that may have passageways with offset portions in a foam layer of the pad positioned to communicate between openings in an abrasive disk attached to the back up pad and vacuum systems in various drive motor assemblies, and a novel method for molding the back up pad to form such passageways.

The coated abrasive back up pad according to the present invention comprises a layer of resiliently compressible foam, means fixed to a front surface of the layer of foam affording attachment of an abrasive disc along a generally planar support surface (e.g., hooks adapted to engage loops on the abrasive disc or a surface to which pressure sensitive adhesive on the disc may be releasably adhered), a generally rigid backing plate fixed to an opposite rear surface of the layer of foam, and means adapted for coupling the backing plate to a drive motor assembly including central concentric openings through the layer of foam and the backing plate affording positioning a threaded end portion of a headed bolt through the opening of the backing plate with the head of the bolt adjacent the backing plate in the central opening in the layer of foam and engagement of the threaded end portion with the drive member of the drive motor assembly. Also included in the back up pad is a plate like adapter having a central opening adapted to pass the threaded end portion of the bolt, parallel bars projecting from a first surface of the adapter on opposite sides of the central opening and having opposed inner surfaces at right angles to the first surface adapted to be positioned in driven contact with outer edge drive surfaces on drive members on first types of drive motor assemblies, and spaced projections from a second surface of the adapter in a ring centered around the central opening and having a diameter at the inner surfaces of the projections exceeding that of the distance between the inner surfaces of the parallel bars to afford engagement of the end surface of drive members on a second type of drive motor assembly with the second surface of the adapter either directly or through a washer. The backing plate has a first set of sockets corresponding in shape to and adapted to closely receive the parallel bars with the first surface of the adapter against the backing plate and with the central openings in the adapter and backing plate aligned to afford driving engagement between drive members on the second type of drive motor assemblies and the second surface on the adapter and thereby between the second type of drive motor assemblies and the back up pad. Also, the backing plate has a second set of sockets corresponding in shape to and adapted to closely receive the spaced projections with the second surface of the adapter against the backing plate and with the central openings in the adapter and backing plate aligned to afford driving engagement between the drive members on the first type of drive motor assemblies and the bars on the adapter and thereby between the first type of drive motor assemblies and the back up pad. Thus the back up pad may be attached to either of the types of drive motor assemblies by selecting the appropriate position for the adapter plate.

Preferably, the back up pad has a concentric circular array of passageways extending through the backing plate, layer of foam and flexible material positioned to communicate between openings in an abrasive disk attached to the back up pad and vacuum systems in various drive motor assemblies. The passageways have inlet openings a first distance from the central opening of the back up pad in the flexible material that are located to correspond to openings in the abrasive disc, outlet openings in the backing plate a second distance from the central opening of the back up pad which second distance is less than the first distance and is adapted so that the outlet openings will communicate with the vacuum systems on various of the drive motor assemblies, and offset portions in the layer of foam that afford communication between those inlet and outlet openings.

Also, preferably, the back up pads are made by a novel process to provide those passageways that includes providing a mold having a top surface, surfaces recessed from the top surface including a bottom surface to define a cavity in the mold, at least one locating pin projecting from the bottom surface, and a tubular die having a cutting edge around the periphery of the die at one end, the die being removably located by the locating pin in the cavity with the cutting edge generally aligned with the top surface of the mold. The cavity is filled with liquid polymeric foam, flexible material is placed over the top surface, cavity, and cutting edge of the die, and the foam is allowed to cure into a flexible solid layer. The flexible material over the flexible foam is then pressed into engagement with the cutting edge of the die so that the cutting edge cuts through the flexible material, the cured layer of foam is removed from the mold, and the die is removed from the layer of foam to provide a passageway through the foam and the flexible material. To form the back up pad described above a plurality of the locating pins and the dies are used with some of the locating pins and dies having support means for removably supporting and locating the dies at positions spaced from the bottom surface of the mold with the cutting edges of the dies generally aligned with the top surface of the mold, the dies offset from sides of the locating pins, and those pins arranged in a circular array with the dies radially outwardly in the array to form, after the placing, filling, pressing, and removing steps described above, the circular array of offset passageway portions through the layer of foam.

BRIEF DESCRIPTION OF DRAWING

The present invention will be further described with reference to the accompanying drawing wherein like reference numerals refer to like parts in the several views, and wherein:

FIG. 8 is a fragmentary sectional view taken approximately along line 7—7 of FIG. 6 in which dies included in the mold assembly are shown positioned on the mold;

FIG. 9 is a fragmentary top view of the mold assembly as illustrated in FIG. 8; and FIG. 10 illustrates a method step used to form the back up pad of FIG. 1 using the mold assembly of FIGS. 6 through 9.

DETAILED DESCRIPTION

Figure 1:
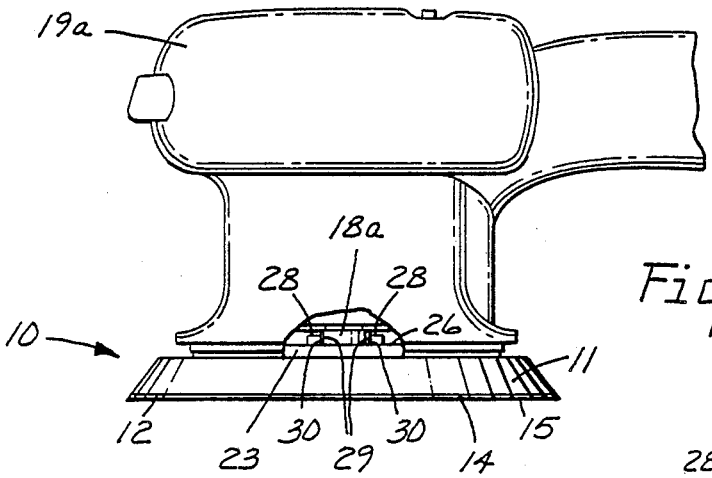
FIG. 1 is a side view of a back up pad according to the present invention attached to a drive motor assembly of a first type.
Figure 2:
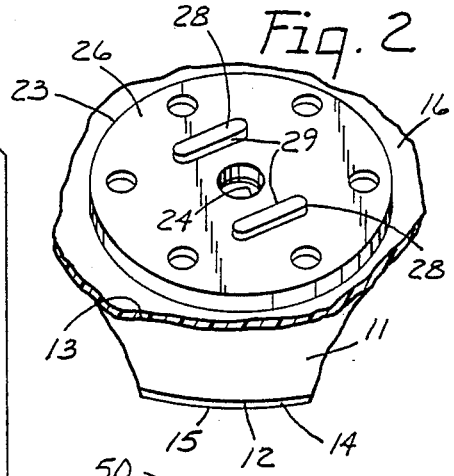
FIG. 2 is an enlarged perspective fragmentary view of the back up pad of FIG. 1.
Figure 3:
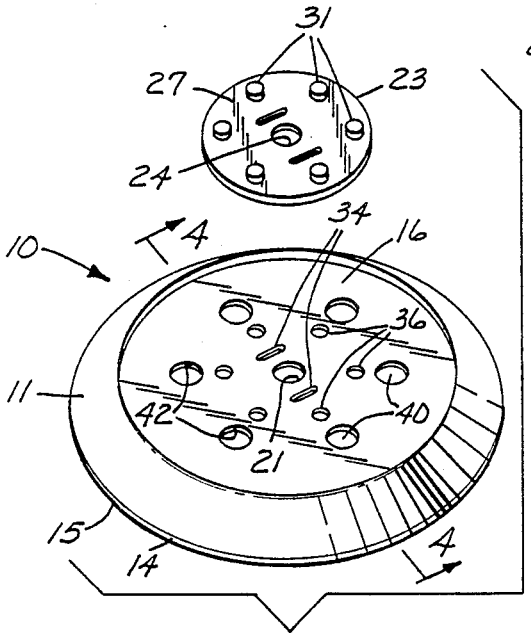
FIG. 3 is an enlarged exploded perspective view of the back up pad of FIG. 1 illustrated with an adapter included in the back up pad inverted as it would be were the back up pad to be attached to a drive motor assembly of a second type.

Referring now to FIGS. 1 through 4 of the drawing, there is shown a back up pad according to the present invention generally designated by the reference numeral 10.

Figure 4:
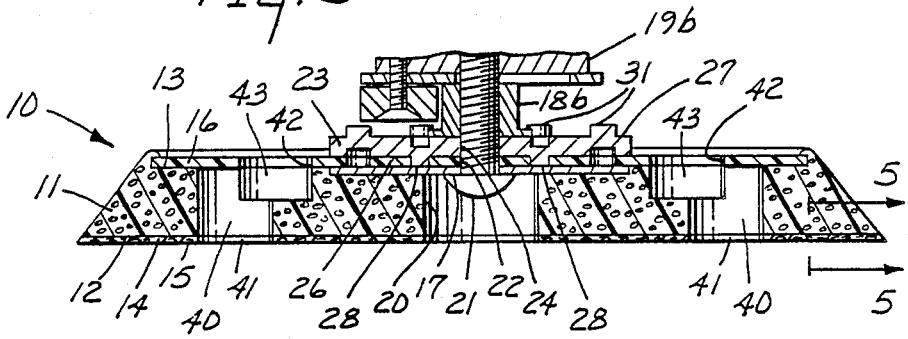
FIG. 4 is an enlarged sectional view taken approximately along line 4—4 of FIG. 2 and illustrating the back up pad attached to a fragment of a drive motor assembly of the second type.
Figure 6:
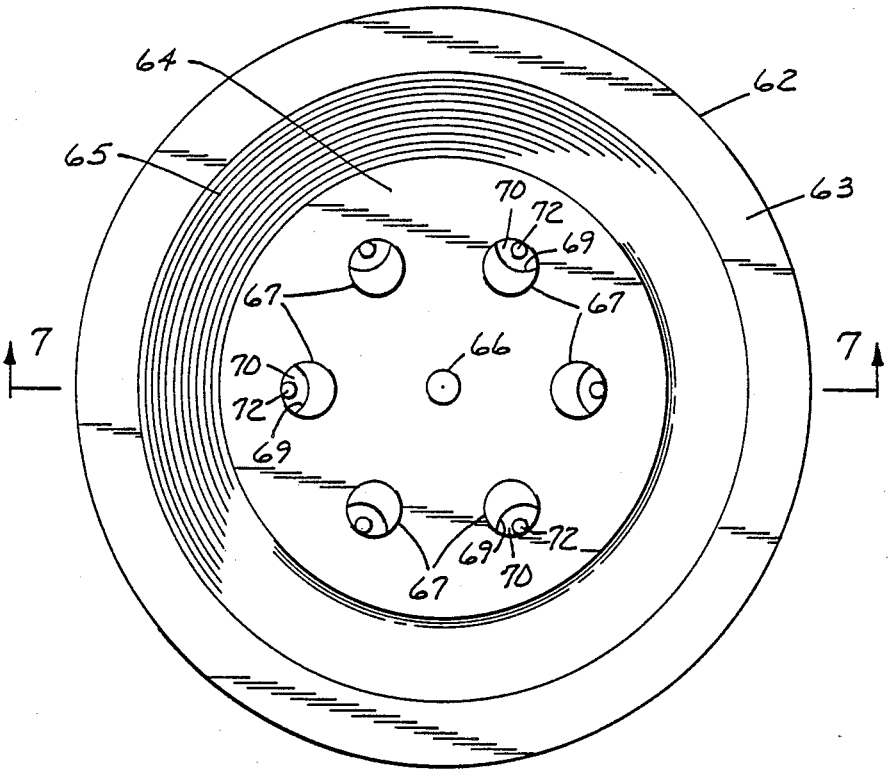
FIG. 6 is a top view of a mold included in a novel mold assembly used in making the back up pad of FIG. 1.
Figure 7:
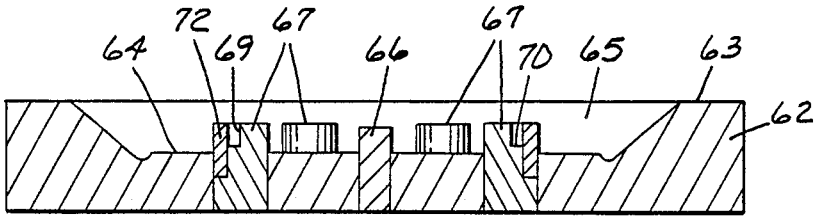
FIG. 7 is a sectional view taken approximately along line 7—7 of FIG. 6.

Generally, as is best seen in FIG. 4, the back up pad 10 comprises a layer 11 of resiliently compressible foam (e.g., polyester urethane foam) having spaced front and rear surfaces 12 and 13, means in the form of a flexible sheet 14 of material (e.g., a sheet of fabric) fixed to the front surface 12 of the layer 11 of foam having a generally planar outer support surface 15 opposite the layer 11 of foam to afford attachment of an abrasive disc (not shown) along the support surface (e.g., as by a layer of pressure sensitive adhesive on the disc adapted to releasably adhere to the support surface 14), a generally rigid backing plate 16 (e.g., of 0.18 centimeter (0.07 inch) thick fiberglass) fixed to the rear surface 13 of the layer 11 of foam, a circular steel reinforcing washer 17 between a central portion of the backing plate 16 and layer 11 of foam, and means adapted for coupling the backing plate 16 to different types of drive members 18*a* or 18*b* on different types of drive motor assemblies 19*a* or 19*b* such as those illustrated in FIGS. 1 and 4 respectively.

The means adapted for coupling the backing plate 16 to such different drive members 18*a* or 18*b* includes a central opening 20 through the layer 11 of foam and smaller concentric openings 21 through the reinforcing washer 17 and backing plate 16 that afford positioning a threaded end portion of a headed bolt 22 through the openings 21 of the reinforcing washer 17 and backing plate 16 with the head of the bolt 20 against the reinforcing washer 17 adjacent the backing plate 16 in the central opening 20 in the layer 11 of foam and engagement of the threaded end portion of the bolt 22 with threads around a central opening in the drive member 18*a* or 18*b*. Also included in the means adapted for coupling the backing plate 16 to the different drive members 18*a* or 18*b* is a circular plate like adapter 23 (e.g., of a metal such as steel or a rigid polymer) that is reversible with respect to the backing plate 16 with one relative position being shown in FIGS. 1 and 2 and the other relative position being shown in FIGS. 3 and 4. The adapter 23 has a central through opening 24 adapted to pass the threaded end portion of the bolt 22, opposite first and second major surfaces 26 and 27, parallel bars 28 projecting from the first major surface 26 of the adapter 23 on opposite sides of its central opening 24 and having opposed inner surfaces 29 at right angles to its first major surface 26 adapted to be positioned in driven contact with outer edge drive surfaces 30 on the drive member 18*a* on the first type of drive motor assembly 19*a* illustrated in FIG. 1 (i.e., the air drive motor assembly commercially designated Festo Dual Action and available from Festo KG, Esslingen/Neckar West Germany). Also, the adapter 23 has equally spaced cylindrical projections 31 from the second major surface 27 of the adapter 23 in a ring concentric with and around its central opening 24 and having a diameter dimension at the inner surfaces of the projections 31 exceeding the distance dimension between the inner surfaces 29 of the parallel bars 28 to afford engagement of the end surface of the drive member 18*b* on the second type of drive motor assembly 19*b* illustrated in FIG. 4 (e.g., the air drive motor assembly commercially designated Rupes Dual Action and available from Rupes Tool, Milan, Italy) with the second major surface 27 of the adapter 23 either directly as illustrated, or through a washer.

The backing plate 16 has a first set of sockets 34 corresponding in shape to and adapted to closely receive the parallel bars 28 with the first major surface 26 of the adapter 23 against the backing plate 16 and with the central openings 24 and 21 in the adapter 23 and backing plate 16 aligned to afford attachment of the bolt 22 and driving engagement between the drive member 18*b* (FIG. 4) and the second major surface 27 on the adapter 23 and thereby between the second type of drive motor assembly 19*b* and the back up pad 10. The backing plate 16 also has a second set of sockets 36 corresponding in shape to and spaced to closely receive the spaced projections 31 on the adapter 23 with the second major surface 27 of the adapter 23 against the backing plate 16 and with the central openings 24 and 21 in the adapter 23 and the backing plate 16 aligned to afford attaching of the bolt 22 and driving engagement between the drive member 18*a* (FIG. 1) and the bars 28 on the adapter 23 and thereby between the first type of drive motor assembly 18*a* and the back up pad 10.

To engage the commercially available drive member 18*a* indicated above, the inner surfaces 29 of the parallel bars 28 are at least 1.2 centimeters (0.5 inch) long and are spaced by about 2 centimeters (0.8 inch); whereas to engage the commercially available drive members 18*b* of the type indicated above the diameter dimension at the inner surfaces of the projections 31 is preferably at least 4 centimeters (1.6 inches).

The back up pad 10 also has a concentric circular array of passageways 40 extending through the backing plate 16, layer 11 of foam and the flexible material 14. The passageways 40 have a circular array of inlet openings 41 a first distance (e.g., 4 centimeters or 1.57 inches) from the center or central openings of the back up pad 10 in the flexible material 14 that correspond to an array of openings in a commercially available abrasive disc that can be adhered to the back up pad 10, (i.e., the abrasive disc commercially designated Stikit (T.M.) disc available from Minnesota Mining and Manufacturing Company, St. Paul, Minnesota) a circular array of outlet openings 42 in the backing plate 16 a second distance (e.g., 3.2 centimeters or 1.26 inches) from the center of the back up pad 10 which second distance is less than the first distance and is adapted so that it will communicate with the vacuum system on various ones of the drive motor assemblies to which the back up pad 10 can be attached, and offset axially parallel cylindrical portions 43 of the passageways 40 in the layer 11 of foam that communicate between those inlet and outlet openings 41 and 42. Thus dust caused when the back up pad 10 is used in abrading a surface can be drawn through the passageways 40 in the back up pad 10 by that vacuum system.

Figure 5:
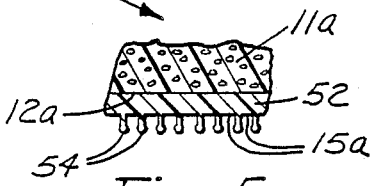
FIG. 5 is a fragmentary view of an alternate embodiment of the back up pad according to the present invention including an alternate flexible material that can be used to provide an attachment surface for the back up pad.

FIG. 5 illustrates an alternate embodiment of a back up pad 50 according to the present invention which is otherwise the same as the back up pad 10 and in which similar parts bear similar reference numerals to which the suffix "a" has been added. The back up pad includes a flexible sheet of material 52 fixed to a front surface **12*a* of a layer 11*a* of foam that has a generally planar outer support surface 15*a* opposite the layer 11*a* of foam and has a multiplicity of hooks 54 projecting along its outer support surface 15*a*** adapted to engage loops along the rear surface of an abrasive disc such as the abrasive disc commercially designated Hookit (T.M.) abrasive disc available from Minnesota Mining and Manufacturing Company, St. Paul, Minnesota).

A method for making a coated abrasive back up pad 10 to conveniently provide the passageways 40 is illustrated in FIGS. 6 through 10. That method includes providing a novel mold assembly 60 (FIG. 8) including a mold 62 best illustrated in FIGS. 6 and 7 that has a top surface 63, surfaces recessed from the top surface 63 including a bottom surface 64 that define a cavity 65 in the mold 62, and pins projecting from the bottom surface 64 including a center locating pin 66 and a plurality of or six passageway locating and partial forming pins 67 equally spaced along a ring concentric with the center locating pin 66. The six passageway locating and partial forming pins 67 each have along their outer sides a notch defined by an arcuate surface 69 that is cylindrically concave around an axis parallel to the axis of the pin 67, and a base surface 70 adjacent and parallel to the bottom surface 64 of the mold 62. A rod 72 projects from the base surface 70 of each of the pins 67 parallel to and centrally spaced from its arcuate surface 69. Also included in the mold assembly 60 are a cylindrically tubular central opening forming die 74 and a plurality of or six partial passageway forming dies 75, with each die 74 or 75 having a circular cutting edge 76 around its periphery at one end. The dies 74 and 75 are removably supported and located by means in the cavity 65 with their cutting edges 76 generally aligned with the top surface 63 of the mold 62. The means for supporting and locating the dies 74 and 75 includes the bottom surface 64 which supports the backing plate 16 on which the ends of the dies 74 and 75 opposite their cutting edges 76 are supported during the molding process (with portions of those ends also being supported on the base surfaces 70 which are then generally parallel to the upper surface of the backing plate 16); the center locating pin 66 that is received in a central socket in and locates the central opening forming die 74 centrally in the cavity 65; and the rods 72 adapted to be positioned in sockets opening through the ends of the partial passageway forming dies 75 opposite their cutting edges 76 so that the partial passageway forming dies 75 are located by the rods 72 and surfaces 69 at positions offset from sides of the pins 67 radially outwardly of those pins 67 with respect to the circular array in which they are located.

Using the mold assembly 60 to form a back up pad 10 includes the steps of placing a pre-formed backing plate 16 against the bottom surface 64 of the mold 62 with its outlet openings 42 and central opening 21 around the pins 67 and 66 respectively, placing a pre-formed reinforcing washer 17 over the backing plate 16 with its central opening 21 around the pin 66, and placing the dies 74 and 75 on the pin 66 and rods 71 respectively so that the cutting edges 76 of the dies 74 and 75 are aligned with the top surface 63 of the mold 60 as is illustrated in FIGS. 8 and 9. The cavity 65 is then filled with liquid polymeric foam; a piece 78 of the flexible material 14 is placed over the top surface 63, cavity 65, and cutting edges 76 of the dies 74 and 75; and the foam is allowed to cure into a flexible solid layer 11. The piece 78 of flexible material over the layer 11 of foam is then pressed into engagement with the cutting edges 76 of the dies 74 and 75 supported in fixed relationship to the bottom surface 64 of the mold 62 as by a rubber plate 80 on the end of a piston 82 (see FIG. 10) so that the cutting edges 76 cut through the piece 78 of flexible material; the cured layer 11 of foam adhered to the backing plate 16 and reinforcing washer 17 is removed from the mold 62, and the dies 74 and 75 are removed from the layer 11 of foam through the holes they have cut in the piece 78 of flexible material to provide both the central opening 20 and the passageways 40 through the layer 11 of foam and the piece 78 of flexible material. The piece 78 of flexible material is then trimmed around the periphery of the layer 11 of foam, and a pre-formed adapter 23 is added to complete the back up pad 10.

The present invention has now been described with reference to one embodiment thereof. It will be apparent to those skilled in the art that many changes can be made in the embodiment described without departing from the scope of the present invention. Thus the scope of the present invention should not be limited to the structures described in this application, but only by structures described by the language of the claims and the equivalents of those structures.

We claim:

1. A coated abrasive back up pad comprising a layer of resiliently compressible foam having spaced front and rear surfaces, means fixed to the front surface of said layer of foam having a generally planar outer support surface opposite said layer of foam for affording attachment of an abrasive disc along said support surface, a generally rigid backing plate fixed to said rear surface of said layer of foam, and means adapted for coupling said backing plate to different types of drive motor assemblies including central concentric openings through said layer of foam and said backing plate affording positioning a threaded end portion of a headed bolt through the opening of the backing plate with the head of the bolt adjacent the backing plate in the central opening in the layer of foam and engagement of the threaded end portion of the bolt with drive members of the drive motor assemblies, a plate like adapter having a central opening through said adapter adapted to pass the threaded end portion of the bolt, opposite first and second major surfaces, parallel bars projecting from said first surface of said adapter on opposite sides of said central opening and having opposed inner surfaces at right angles to said first surface adapted to be positioned in driven contact with outer edge drive surfaces on drive members on first types of drive motor assemblies, and spaced projections from the second surface of said adapter in a ring centered around said central opening and having a diameter at the inner surfaces of said projections exceeding that of the distance between said inner surfaces of said parallel bars to afford engagement of the end surfaces of drive members on second types of drive motor assemblies with the second surface of said adapter either directly or through a washer, said backing plate having a first set of sockets corresponding in shape to and adapted to closely receive said parallel bars with the first surface of said adapter against said backing plate and with the central openings in said adapter and backing plate aligned to afford driving engagement between the drive members on the second types of drive motor assemblies and the second surface on the adapter and thereby between the second types of drive motor assemblies and the back up pad, and said backing plate having a second set of sockets corresponding in shape to and adapted to closely receive said spaced projections with the second surface of said adapter against said backing plate and with the central openings in said adapter and backing plate aligned to afford driving engagement between the drive members on the first types of drive motor assemblies and the bars on the adapter and thereby between the first types of drive motor assemblies and the back up pad.

2. A back up pad according to claim 1 wherein the inner surfaces of said parallel bars are at least 1.2 centimeters long and are spaced by about 2 centimeters.

3. A back up pad according to claim 1 wherein said spaced projections are cylindrical and are equally spaced in a circular array around said central opening.

4. A back up pad according to claim 1 wherein said back up pad has a circular array of passageways centered around said central opening and extending through the backing plate, layer of foam and flexible material, said passageways having inlet openings a first radial distance from the central opening, outlet openings in said backing plate a second radial distance from the central opening which second distance is less than said first distance, and offset portions in said layer of foam.

5. A back up pad according to claim 1 wherein said layer of foam is polyester urethane, said backing plate is fiberglass, and said adapter is of metal.

6. A method for making a coated abrasive back up pad comprising the steps of providing a mold having a top surface, surfaces recessed from the top surface including a bottom surface to define a cavity in the mold, at least one locating pin projecting from the bottom surface, and a tubular die having a cutting edge around the periphery of the die at one end, the die being removably located by the locating pin in the cavity with the cutting edge generally aligned with the top surface of the mold;

placing a flexible material over the top surface, cavity, and cutting edge of the die;

filling the cavity with liquid polymeric foam and allowing it to cure into a flexible solid;

pressing the flexible material over the flexible foam into engagement with the cutting edge of the die so that the cutting edge cuts through the flexible material; removing the cured foam from the mold; and removing the die from the foam to provide a passageway through the layer of foam and the flexible material.

7. A method according to claim 6 wherein said providing step provides a plurality of the locating pins and the dies, at least some of the locating pins having support means for removably supporting and locating the dies at positions spaced from the bottom surface of the mold with the cutting edges of the dies generally aligned with the top surface of the mold and the dies offset from sides of the locating pins to provide, after said placing, filling, pressing, and removing steps, offset passageway portions through the layer of foam.

8. A method according to claim 7 wherein the locating pins having support means for removably supporting and locating the dies at positions spaced from the bottom surface of the mold with the cutting edges of the dies generally aligned with the top surface of the mold and the dies offset from sides of the locating pins are arranged in a circular array with the dies radially outwardly of the locating pins in the array to form, after said placing, filling, pressing, and removing steps, a circular array of offset passageway portions through the layer of foam.

9. A mold assembly for making a coated abrasive back up pad comprising a mold having a top surface, surfaces recessed from said top surface including a bottom surface to define a cavity in said mold, and at least one locating pin projecting from said bottom surface, a tubular die having a cutting edge around the periphery of the die at one end, and locating means including portions of said die and said locating pin adapted to releasably engage for supporting and positioning the die at a predetermined location in the cavity with said cutting edge generally aligned with the top surface of said mold so that when a flexible material is placed over the top surface, cavity, and cutting edge of the die, the cavity is filled with liquid un-cured polymeric foam that is allowed to cure into a flexible solid, the flexible material over the flexible foam is pressed into engagement with the cutting edge of the die so that the cutting edge cuts through the flexible material, the cured foam is removed from the die, and the die is removed from the foam, a passageway will be present in the layer of foam and the flexible material.

10. A mold according to claim 9 wherein said mold includes a plurality of said locating pins, a plurality of said dies, and locating means including portions of said dies and said locating pins adapted to releasably engage for supporting and positioning the dies at predetermined locations in the cavity with said cutting edges generally aligned with the top surface of said mold, at least some of said locating means supporting said dies on said pins at positions spaced from said bottom surface with said dies offset from the sides of said locating pins so that when a flexible material is placed over the top surface, cavity, and cutting edges of the dies, the cavity is filled with liquid uncured polymeric foam that is allowed to cure into a flexible solid layer of foam, the flexible material over the flexible layer of foam is pressed into engagement with the cutting edges of the dies so that the cutting edges cut through the flexible material, the cured layer of foam is removed from the mold, and the dies are removed from the layer of foam, passageways will extend through the layer of foam and flexible material that have offset passageway portions in the layer of foam.

11. A mold according to claim 10 wherein said pins and dies including locating means supporting said dies on said pins at positions spaced from said bottom surface with said dies offset from the sides of said locating pins are arranged in a circular array with the dies radially outwardly of said pins in the array so that when a flexible material is placed over the top surface, cavity, and cutting edges of the dies, the cavity is filled with uncured liquid polymeric foam that is allowed to cure into a flexible solid layer of foam, the flexible material over the flexible layer of foam is pressed into engagement with the cutting edges of the dies so that the cutting edges cut through the flexible material, the cured layer of foam is removed from the mold, and the dies are removed from the layer of foam, a circular array of passageways will extend through the layer of foam and flexible material that have offset passageway portions in the layer of foam.

* * * * *